US010281943B1

(12) United States Patent
Ho

(10) Patent No.: US 10,281,943 B1
(45) Date of Patent: May 7, 2019

(54) LOW DROPOUT REGULATOR WITH A CONTROLLED STARTUP

(71) Applicant: ELITE SEMICONDUCTOR MEMORY TECHNOLOGY INC., Hsinchu (TW)

(72) Inventor: I-Hsiu Ho, Zhubei (TW)

(73) Assignee: ELITE SEMICONDUCTOR MEMORY TECHNOLOGY INC., Hsinchu (TW)

( * ) Notice: Subject to any disclaimer, the term of this patent is extended or adjusted under 35 U.S.C. 154(b) by 0 days.

(21) Appl. No.: 15/964,695

(22) Filed: Apr. 27, 2018

(51) Int. Cl.
*G05F 1/575* (2006.01)

(52) U.S. Cl.
CPC ..... *G05F 1/575* (2013.01)

(58) Field of Classification Search
CPC ..... G05F 1/575
See application file for complete search history.

(56) References Cited

U.S. PATENT DOCUMENTS

2013/0113447 A1* 5/2013 Kadanka ..... G05F 1/56 323/280
2017/0199537 A1* 7/2017 Duong ..... G05F 1/575
2017/0242449 A1* 8/2017 Chen ..... G05F 1/575

* cited by examiner

*Primary Examiner* — Kyle J Moody
(74) *Attorney, Agent, or Firm* — Juan Carlos A. Marquez; Marquez IP Law Office, PLLC

(57) ABSTRACT

A low dropout voltage regulator incorporates an N-channel MOS pass transistor, a main error amplifier, a first buffer circuit, an auxiliary error amplifier, a second buffer circuit, and a decision circuit. The auxiliary error amplifier consumes less bias current. In one embodiment, the decision circuit compares the portion of the output voltage with a bias voltage to control the gate of the N-channel MOS pass transistor, wherein the value of the bias voltage is less than the value of the reference voltage.

10 Claims, 3 Drawing Sheets

LOW DROPOUT REGULATOR WITH A CONTROLLED STARTUP

BACKGROUND OF THE INVENTION

1. Field of the Invention

The present invention generally relates to an LDO (low dropout) voltage regulator, and more specifically to a low dropout voltage regulator with a controlled startup.

2. Description of the Related Art

An LDO voltage regulator is a DC linear voltage regulator, which can operate with a very small input-output differential voltage. The advantages of an LDO voltage regulator include a lower minimum operating voltage, higher efficiency operation and lower heat dissipation. The main components of a typical LDO voltage regulator may include a pass transistor and an error amplifier. The pass transistor and the error amplifier cooperate to maintain a constant DC output voltage.

A controlled startup is one of the main challenges and requirements in voltage regulators. Voltage overshoots and inrush currents can cause damage to the load and to voltage regulator components. For example, at start up, the error amplifier senses that the output voltage is low, and the pass transistor is driven as hard as possible to meet the load requirement. The pass transistor therefore pulls a large inrush current to charge an output capacitance, which is undesirable and may cause the damage.

Therefore, an LDO voltage regulator with a controlled startup mechanism is needed.

SUMMARY OF THE INVENTION

One aspect of the present invention is a low dropout voltage regulator.

According to one embodiment of the present invention, the low dropout voltage regulator comprises an N-channel MOS pass transistor, a main error amplifier, a first buffer circuit, an auxiliary error amplifier, a second buffer circuit, and a decision circuit. The N-channel MOS pass transistor has a drain coupled to receive an input voltage and a source coupled to generate an output voltage. The main error amplifier has a positive input coupled to receive a portion of the output voltage, a negative input coupled to receive a reference voltage, and an amplifier output. The first buffer circuit is coupled between the amplifier output of the main error amplifier and a gate of the N-channel MOS pass transistor. The auxiliary error amplifier consumes less bias current. The auxiliary error amplifier has a first positive input coupled to receive the portion of the output voltage, a second positive input, a negative input coupled to receive the reference voltage, and an amplifier output. The second buffer circuit is coupled between the amplifier output of the auxiliary error amplifier and the gate of the N-channel MOS pass transistor. The decision circuit is configured to compare the portion of the output voltage with a bias voltage to control the gate of the N-channel MOS pass transistor. The value of the bias voltage is less than the value of the reference voltage.

BRIEF DESCRIPTION OF THE DRAWINGS

The invention will be described according to the appended drawings in which.

DETAILED DESCRIPTION OF THE INVENTION

Figure 1:
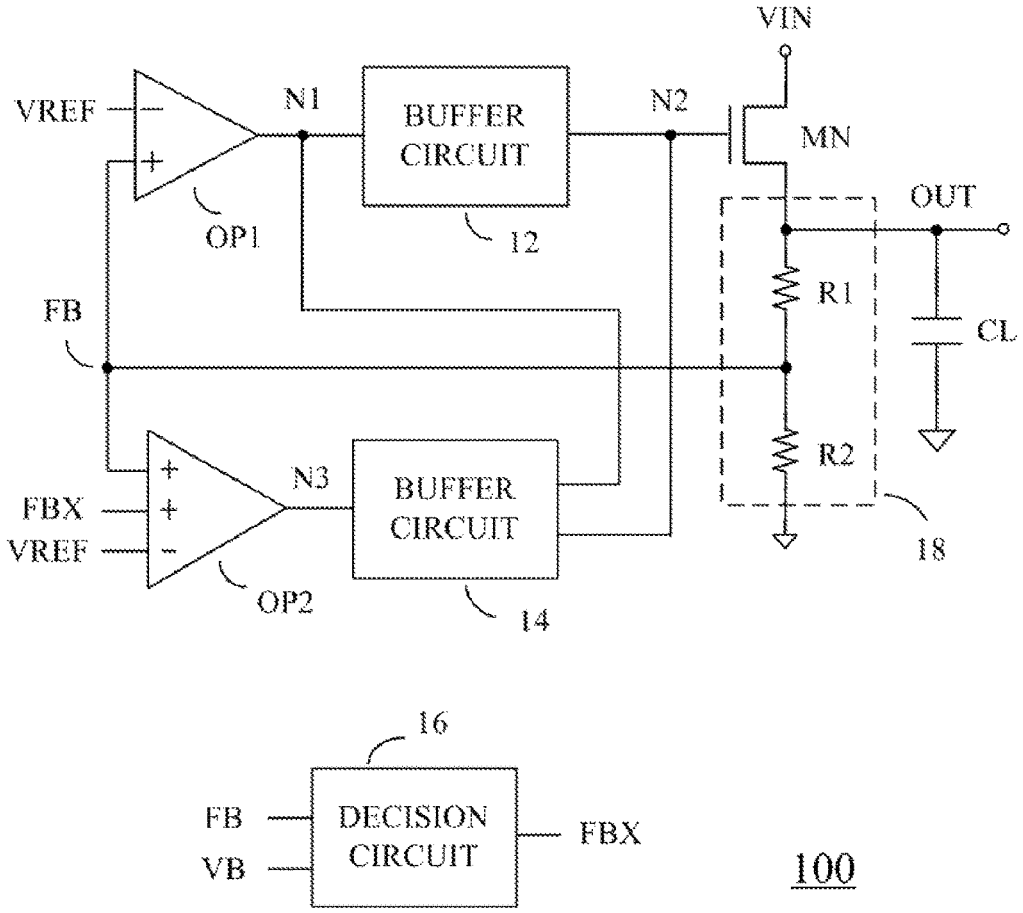
FIG. 1 shows a block diagram of an LDO voltage regulator 100 utilizing an N-channel pass transistor MN according to one embodiment of the present invention.

FIG. 1 shows a block diagram of an LDO voltage regulator 100 utilizing an N-channel pass transistor MN according to one embodiment of the present invention. Referring to FIG. 1, the LDO voltage regulator 100 includes a main error amplifier OP1, a first buffer circuit 12, a large N-channel pass transistor MN and a voltage divider 18.

The pass transistor MN has its drain connected to a power supply input voltage VIN. The source of the pass transistor MN1 is connected to the voltage divider 18 and an output capacitor CL on which the regulated output voltage OUT is generated.

The negative input of the main error amplifier OP1 is coupled to receive a reference voltage VREF, which typically is generated by a conventional band gap reference circuit (not shown). The voltage divider circuit 18 including feedback resistors R1 and R2 sends a portion of the regulated output voltage OUT to the positive input of the main error amplifier OP1. The main error amplifier OP1 compares the portion of the regulated output voltage OUT of the LDO voltage regulator 100 with the reference voltage VREF (e.g., 1.2 V) and generates an error signal N1. The first buffer circuit 12 is coupled to the error amplifier OP1 and can shift a voltage level of the error signal N1 to facilitate the low dropout operation of the pass transistor MN.

In the normal operation, the output of the main error amplifier OP1 is used to drive a gate of N-channel MOS pass transistor MN through the first buffer circuit 12, which functions as a source follower and therefore causes the output voltage OUT to "follow" the reference voltage VREF according to a feedback voltage FB generated by the voltage divider 18. In other words, the main error amplifier OP1, the first buffer circuit 12 and the pass transistor MN constitute a first negative feedback loop, which forces the portion of the regulated output voltage OUT (i.e., the feedback voltage FB), and the reference voltage VREF to be substantially equal.

However, during a startup phase of the LDO voltage regulator 100, when the LDO voltage regulator 100 is powered on, the first buffer circuit 12 may pull a node N2 from a ground voltage to a voltage VGS, wherein VGS is the gate-source voltage of a transistor (not shown). Therefore, the pass transistor MN is driven, and an output voltage OUT may pull to an undesired voltage level at startup, which leads to inrush current and component damage.

In order to solve the above problem, the LDO voltage regulator 100 furthermore includes an auxiliary error amplifier OP2, a second buffer circuit 14 and a decision circuit 16 as shown in FIG. 1. The auxiliary error amplifier OP2 consumes less bias current than the main error amplifier OP1. In one embodiment, the auxiliary error amplifier OP2 is a simple design without temperature or process compensation to consume less than 10 μA, and the main error amplifier OP1 consumes about 160 μA due to a more complex design.

The decision circuit 16 compares the feedback voltage FB with a bias voltage VB and generates a decision signal FBX.

The first positive input of the auxiliary error amplifier OP2 is coupled to the feedback voltage FB, the second positive input of the auxiliary error amplifier OP2 is coupled to the decision signal FBX, and the negative input of the auxiliary error amplifier OP2 is coupled to receive the reference voltage VREF. The second buffer circuit 14 is coupled to the error amplifier OP2, and can shift a voltage level of an error signal N3 to facilitate the low dropout operation of the transistor MN. The gate of the pass transistor MN is coupled to the second buffer circuit 14.

Figure 2:
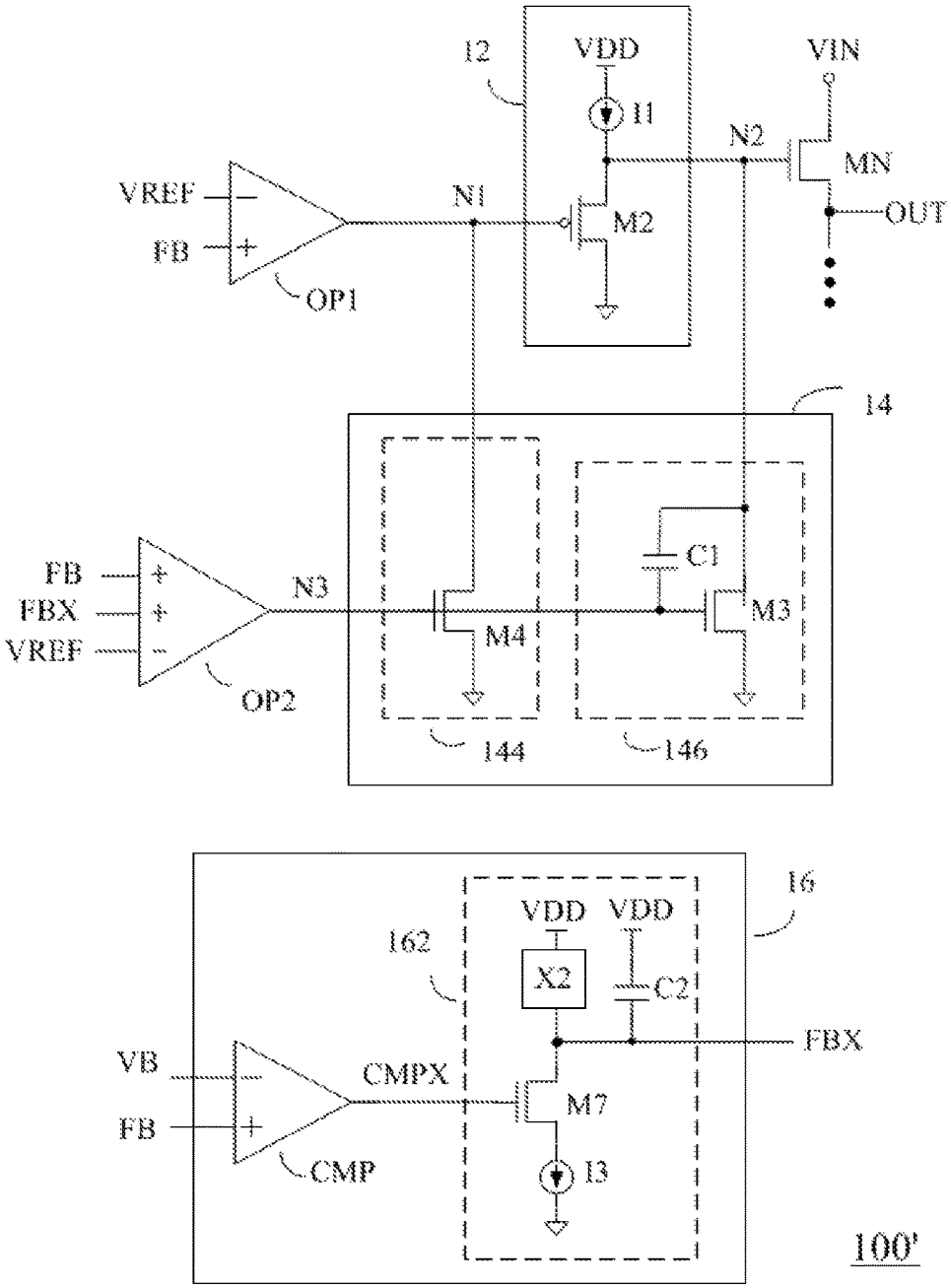
FIG. 2 shows a schematic diagram of the LDO voltage regulator 100' according to one embodiment of the present invention.

FIG. 2 shows a schematic diagram of the LDO voltage regulator 100' according to one embodiment of the present invention. Referring to FIG. 2, the first buffer circuit 12 includes a P-channel MOS transistor M2 and a current source I1, wherein the P-channel MOS transistor M2 has a drain coupled to a ground terminal, a gate coupled to the output of main error amplifier OP1, and a source coupled to the current source 12.

Referring to FIG. 2, the second buffer circuit 14 includes a first output stage 144 having an input coupled to the output of the auxiliary error amplifier OP2 and a second output stage 146 having an input coupled to the output of the auxiliary error amplifier OP2.

In one embodiment, the first output stage 144 includes an N-channel MOS transistor M4. The N-channel MOS transistor M4 has a drain coupled to the output of the main error amplifier OP1, a gate coupled to the output of the auxiliary error amplifier OP2, and a source coupled to the ground terminal.

In one embodiment, the second output stage 146 includes an N-channel MOS transistor M3 and a capacitor C1. The N-channel MOS transistor M3 has a gate coupled to receive the error signal N3, a drain coupled to the gate of the pass transistor MN, and a source coupled to the ground terminal. The capacitor C1 is coupled between the gate of the pass transistor MN and the gate of the transistor M3.

Referring to FIG. 2, the decision circuit 16 includes a comparator CMP and an output stage 162. The comparator CMP compares the feedback voltage FB with a bias voltage VB and generates a comparison signal CMPX. The output stage 162 has an input coupled to receive the comparison signal CMPX.

Figure 3:
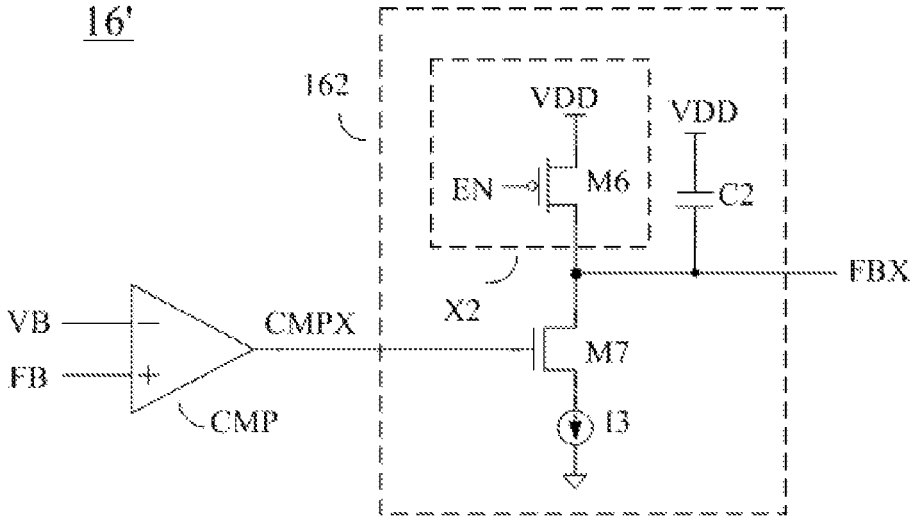
FIG. 3 illustrates an example of the enable element.

In one embodiment, the output stage 162 includes an N-channel MOS transistor M7, an enable element X2, a current source I3, and a capacitor C2. The N-channel MOS transistor M7 has a gate coupled to receive the comparison signal CMPX, a drain coupled to the enable element X2, and a source coupled to the current source I3. FIG. 3 illustrates an example of the enable element X2. Referring to FIG. 3, the enable element X2 is formed by a P-channel MOS transistor M6 having a source coupled to the supply power voltage VDD, a gate coupled to receive an enable signal EN, and a drain coupled to the drain of the transistor M7.

Referring to FIG. 2, during the startup phase of the LDO voltage regulator 100', when the LDO voltage regulator 100' is powered on, the reference voltage VREF is reset to 0 V. When the feedback voltage FB is less than the bias voltage VB (e.g., 0.3V), the comparator CMP delivers the value "0", and thus the transistor M7 turns off. When the transistor M7 turns off, the enable element X2 pulls the decision signal FBX very close to the supply voltage VDD rapidly. At this time, since the decision signal FBX is higher than the feedback signal FB and the reference voltage VREF is still small, the auxiliary error amplifier OP2 compares the feedback voltage FB with the reference voltage VREF and delivers the value "1".

When the auxiliary error amplifier OP2 delivers the value "1", the transistor M4 turns on, which pulls the node N1 very close to the ground voltage. In the meantime, the transistor M3 turns on, which pulls the node N2 very close to the ground voltage. Therefore, the pass transistor MN turns off. Since the pass transistor MN turns off, the output voltage OUT is pulled down to the ground voltage at beginning.

Subsequently, the reference voltage VREF rises according to a predetermined ramp. Therefore, the auxiliary error amplifier OP2, the transistor M3 of the second buffer circuit 14, the capacitor C1 and the pass transistor MN constitute a second negative feedback loop, which forces the portion of the regulated output voltage OUT (i.e., voltage FB), and the reference voltage VREF to be substantially equal.

When the feedback voltage FB rises close to the bias voltage VB, the comparator CMP delivers the value "1", and thus the transistor M7 turns on. When the transistor M7 turns on, the current source I3 discharges the energy stored in the capacitor C2, and thus the voltage FBX falls slowly in a fixed rate. When the voltage FBX is less than the feedback voltage FB, the auxiliary error amplifier OP2 delivers the value "0", and thus the transistors M3 and M4 turn off. In other words, the second negative feedback loop inactives and the first negative feedback loop controls the operation of the LDO voltage regulator 100'.

With such circuit configurations as shown in FIG. 1 and FIG. 2, the low dropout regulator can have a controlled startup. Therefore, the low dropout regulator can avoid voltage overshoots and inrush currents during startup.

The above-described embodiments of the present invention are intended to be illustrative only. Numerous alternative embodiments may be devised by those skilled in the art without departing from the spirit and scope of the invention as recited in the following claims.

What is claimed is:

1. A low dropout voltage regulator, comprising:

an N-channel MOS pass transistor having a drain coupled to receive an input voltage and a source coupled to generate an output voltage;

a main error amplifier having a positive input coupled to receive a portion of the output voltage, a negative input coupled to receive a reference voltage, and an amplifier output;

a first buffer circuit coupled between the amplifier output of the main error amplifier and a gate of the N-channel MOS pass transistor;

an auxiliary error amplifier which consumes less bias current than the main error amplifier, the auxiliary error amplifier having a first positive input coupled to receive the portion of the output voltage, a second positive input, a negative input coupled to receive the reference voltage, and an amplifier output;

a second buffer circuit coupled between the amplifier output of the auxiliary error amplifier and the gate of the N-channel MOS pass transistor; and a decision circuit configured to compare the portion of the output voltage with a bias voltage to control the gate of the N-channel MOS pass transistor;

wherein a value of the bias voltage is less than the value of the reference voltage.

2. The low dropout voltage regulator of claim 1, wherein the first buffer circuit comprises:

a P-channel MOS transistor, having a source coupled to the gate of the N-channel MOS pass transistor, a gate coupled to the amplifier output of the main error amplifier, and a drain coupled to a ground terminal; and a current source coupled to the source of the P-channel MOS transistor.

3. The low dropout voltage regulator of claim 1, wherein the second buffer circuit comprises:

a first output stage having an input coupled to the amplifier output of the auxiliary error amplifier, and an output coupled to the amplifier output of the main error amplifier; and a second output stage, having an input coupled to the amplifier output of the auxiliary error amplifier, and an output coupled to the gate of the N-channel MOS pass transistor.

4. The low dropout voltage regulator of claim 3, wherein the first output stage comprises:

a first N-channel MOS transistor having a gate coupled to the amplifier output of the auxiliary error amplifier, a drain coupled to the amplifier output of the main error amplifier, and a source coupled to the ground terminal.

5. The low dropout voltage regulator of claim 3, wherein the second output stage comprises:

a second N-channel MOS transistor, having a gate coupled to the amplifier output of the auxiliary error amplifier, a drain coupled to the gate of the N-channel MOS pass transistor, and a source coupled to the ground terminal; and a capacitor coupled between the gate of the N-channel MOS pass transistor and the gate of the second N-channel MOS transistor.

6. The low dropout voltage regulator of claim 1, wherein the decision circuit comprises:

a comparator configured to compare the portion of the output voltage with the bias voltage to generate a comparison signal; and an output stage having an input coupled to receive the comparison signal and an output coupled to the second positive input of the auxiliary error amplifier.

7. The low dropout voltage regulator of claim 6, wherein the output stage of the decision circuit comprises:

an N-channel MOS transistor having a gate coupled to receive the comparison signal, a drain coupled to the second positive input of the auxiliary error amplifier;

a capacitor coupled the drain of the N-channel MOS transistor; and a current source coupled to a source of the N-channel MOS transistor.

8. The low dropout voltage regulator of claim 1, wherein during a startup phase, the reference voltage is reset and then rises according to a predetermined ramp; when the portion of the output voltage is less than the bias voltage, the auxiliary error amplifier, the second buffer circuit, and the N-channel MOS pass transistor constitute a first negative feedback loop which forces the portion of the output voltage and the reference voltage to be substantially equal.

9. The low dropout voltage regulator of claim 8, wherein when the portion of the output voltage is larger than the bias voltage, the main error amplifier, the first buffer circuit, and the N-channel MOS pass transistor constitute a second negative feedback loop which forces the portion of the output voltage and the reference voltage to be substantially equal.

10. The low dropout voltage regulator of claim 9, wherein when the portion of the output voltage rises close to the bias voltage, the decision circuit sends a first signal falling in a fixed rate to the second positive input of the auxiliary error amplifier and when the first signal is less than the portion of the output voltage, the second negative feedback loop activates and the first negative feedback loop deactivates.

* * * * *